US005432685A

United States Patent [19]

Taksukawa et al.

[11] Patent Number: 5,432,685

[45] Date of Patent: Jul. 11, 1995

[54] VEHICULAR HEADLIGHT REFLECTOR HAVING INNER AND OUTER REFLECTING SURFACES

[75] Inventors: Masashi Taksukawa; Hiroshi Kawashima; Akira Miura, all of Shizuoka, Japan

[73] Assignee: Koito Manufacturing Co., Ltd., Tokyo, Japan

[21] Appl. No.: 78,651

[22] Filed: Jun. 21, 1993

[30] Foreign Application Priority Data

Aug. 14, 1992 [JP] Japan ..... 4-237588

[51] Int. Cl.[6] ..... F21M 3/08

[52] U.S. Cl. ..... 362/61; 362/297; 362/346

[58] Field of Search ..... 362/61, 80, 297, 346

[56] References Cited

U.S. PATENT DOCUMENTS

| | | | |
|---|---|---|---|
| 4,530,042 | 7/1985 | Cibie et al. . | |
| 4,754,374 | 6/1988 | Collot . | |
| 4,803,601 | 2/1989 | Collot et al. . | |
| 4,945,454 | 7/1990 | Bunse et al. | 362/346 |
| 5,003,447 | 3/1991 | James et al. | 362/346 |
| 5,079,677 | 1/1992 | Kumagai | 362/346 |
| 5,086,376 | 2/1992 | Blusseau | 362/346 |
| 5,171,082 | 12/1992 | Watanabe | 362/346 |
| 5,192,124 | 3/1993 | Kawashima et al. . | |
| 5,215,368 | 6/1993 | Neumann | 362/346 |
| 5,258,897 | 11/1993 | Nino | 362/346 |

FOREIGN PATENT DOCUMENTS

| | | |
|---|---|---|
| 2000266 | 1/1979 | European Pat. Off. . |
| 2123134 | 1/1984 | European Pat. Off. . |
| 4138322 | 8/1992 | Germany . |

*Primary Examiner*—Richard R. Cole

*Attorney, Agent, or Firm*—Sughrue, Mion, Zinn, Macpeak & Seas

[57] ABSTRACT

A reflecting surface consists of an inner surface and an outer surface, and a filament is disposed along the optical axis of the reflector. The inner surface produces a projection pattern extended in the horizontal direction. The upper half of the inner surface produces a projection pattern below the horizontal center line. Of the lower half of the inner surface, a subsection located on one side of the vertical center plane of the reflector produces a projection pattern contributing to formation of the inclined cutline, and the other subsection located on the other side of the vertical center plane produces a projection pattern contributing to formation of the horizontal cutline. The outer surface produces a projection pattern concentrated in a central area. The upper half of the outer surface produces a projection pattern below the horizontal center line. Of the lower half of the outer surface, a subsection located on one side of the vertical center plane of the reflector produces a projection pattern contributing to formation of the inclined cutline, and the other subsection located on the other side of the vertical center plane produces a projection pattern contributing to formation of the horizontal cutline.

12 Claims, 14 Drawing Sheets

VEHICULAR HEADLIGHT REFLECTOR HAVING INNER AND OUTER REFLECTING SURFACES

BACKGROUND OF THE INVENTION

The present invention relates to a reflector of a vehicular low beam headlight.

Conventional vehicular low beam headlights have a fundamental configuration in which a coil-like filament is disposed in the vicinity of the focus of a paraboloid-of-revolution reflector with the central axis of the filament extending along the optical axis of the reflector (what is called C8-type arrangement), and a shade is placed under the filament to produce a cutline (or cut-off line) in a light-distribution pattern.

In this case, the part of the light emitted from the filament and going toward the lower half of the reflector is shielded by the shade and does not contribute to the formation of a light-distribution pattern. A resultant light-distribution pattern, which is formed on a screen located in front of the reflector at a predetermined distance, becomes a generally semi-circular pattern having a first cutline forming a certain angle with the horizontal center line and a second cutline extending along the horizontal center line.

A horizontally spread low beam light-distribution pattern is finally obtained as a result of light-distribution control by diffusive lens steps of an outer lens that is disposed in front of the reflector.

In recent years, with the streamlined styling of vehicle bodies which is required from the aerodynamic characteristics and designing, headlights need to be designed so as to conform to what is called the slant-nose shape of the front portion of vehicle bodies. More specifically, headlights should be vertically thin and have a large slant angle (i.e., an angle between the outer lens and the vertical direction).

It is not appropriate to provide highly diffusive lens steps on the outer lens having a large inclination in the manner as in the conventional case. (The provision of highly diffusive lens steps would cause a phenomenon that tailing of light occurs at the right and left end portions of the light-distribution pattern.) This will impose a serious limitation on the design of lens steps.

On the other hand, the use of the shade, which unavoidably causes an unusable reflector area, i.e., reduces the ratio of light flux utilization, is not preferable for the thinning of the headlight. It is desired to effectively use the entire area of the reflector to provide the horizontal spread and a clear cutline in the light-distribution pattern.

SUMMARY OF THE INVENTION

An object of the present invention is to provide a novel vehicular headlight reflector which can produce a low beam light-distribution pattern having a clear cutline by effectively using the entire area of the reflector, and can accommodate the slanting of outer lens as required from the streamlining of vehicle bodies.

According to the invention, in a vehicular headlight for producing a low beam light-distribution pattern comprising a reflector and a light source with a longitudinal dimension along the optical axis of the reflector, the reflector comprises:

a continuous, smooth inner surface surrounding the optical axis, for producing a projection pattern diffused in the horizontal direction; and a continuous, smooth outer surface located outside of and connected to the inner surface, for producing a projection pattern concentrated in a central area.

The upper half of the inner surface produces a projection pattern below the horizontal center line, a first right/left half section of the lower half of the inner surface produces a projection pattern contributing to formation of a first cutline inclined from the horizontal center line, and a second right/left half section of the lower half of the inner surface produces a projection pattern contributing to formation of a second cutline in parallel with the horizontal center line.

The upper half of the outer surface produces a projection pattern below the horizontal center line, a first right/left half section of the lower half of the outer surface produces a projection pattern contributing to formation of the first cutline, and a second right/left half section of the lower half of the outer surface produces a projection pattern contributing to formation of the second cutline.

DESCRIPTION OF THE PREFERRED EMBODIMENT

A reflector according to an embodiment of the present invention is described hereinafter with reference to FIGS. 1–15. A reflector 1 of this embodiment is one to be used for a rectangular headlight.

To provide a clear cutline specifically required in the low beam light-distribution pattern by using the entire reflecting surface without employing a shade under a filament, a reflecting surface 2 of the reflector 1 is constituted of two sectional surfaces (see FIG. 1) having different light-distribution control functions, and each of the two surfaces is further divided into a plurality of subsections for defining details of the light-distribution pattern.

Figure 1:
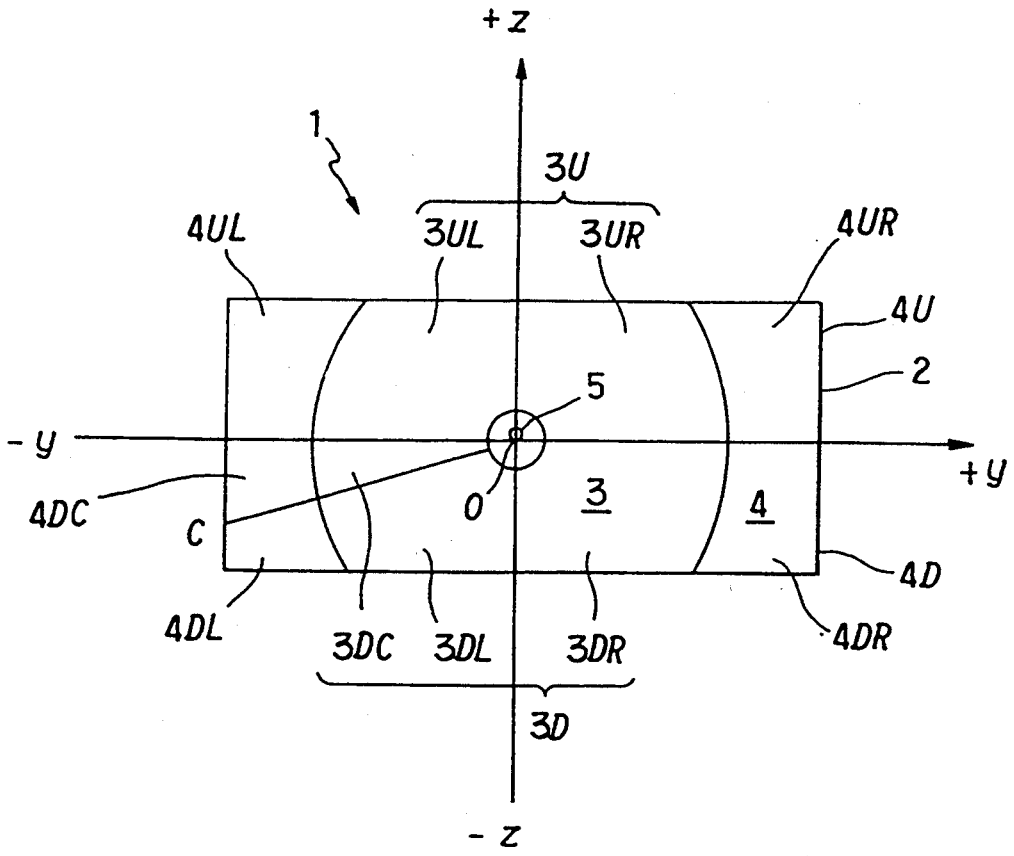
FIG. 1 is a front view of a reflector according to the present invention.

That is, when viewed from the front side (i.e., along the optical axis (x-axis) that is perpendicular to the paper surface of FIG. 1), the reflecting surface 2 is generally divided into an inner (closer to the optical axis) surface 3 and an outer surface 4 that is provided on the right and left sides of the inner surface 3. In FIG. 1, the horizontal axis perpendicular to the x-axis is the y-axis, the vertical axis perpendicular to both of the x- and y-axes is the z-axis, and the origin of this orthogonal coordinate system is represented by O.

Figure 2:
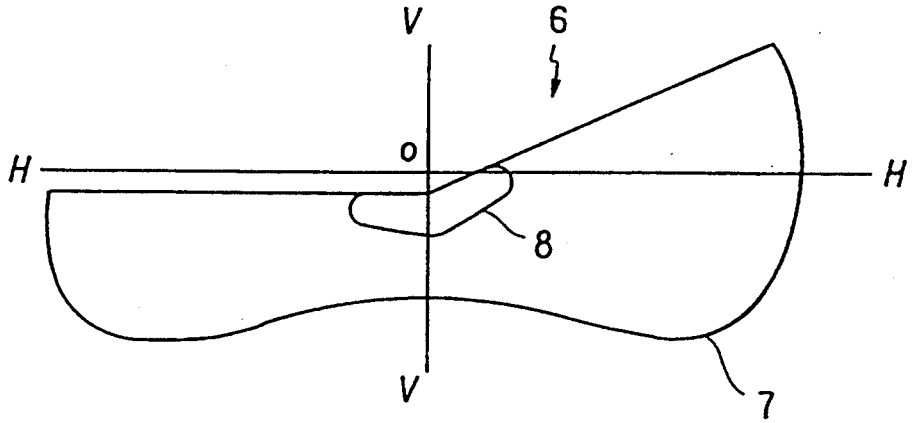
FIG. 2 shows a general light-distribution pattern produced by the reflector of FIG. 1.

FIG. 2 generally shows a low beam light-distribution pattern 6 that is projected on a screen located in front of the reflector 1 with a filament 5 disposed along the optical axis of the reflector 1. In FIG. 2, H—H and V—V represent the horizontal and vertical center lines, respectively, and o represents the intersection of these lines.

As shown in FIG. 2, a pattern 7 produced by the inner surface 3 is spread in the horizontal direction and its upper edge defines a cutline over a wide length. A pattern 8 obtained by the outer surface 4 contributes to the formation of a concentrated portion (what is called a "hot zone") immediately below the point o.

The inner surface 3 is divided into a section 3U located above ($z>0$) the x-y plane and a section 3D located below ($z<0$) the x-y plane. The section 3U is further divided by the x-z plane into subsections 3UL ($y<0$) and 3UR ($y>0$). The section 3D is further divided by the x-z plane and a plane O-C that is rotated about the x-axis so as to be inclined from the x-y plane by a predetermined angle, into a subsection 3DC (occupying the area between the x-y plane and the plane O-C), a subsection 3DL ($y<0$) and a subsection 3DR ($y>0$).

The outer surface 4 is divided into a section 4U located above ($z>0$) the x-y plane and a section 4D located below ($z<0$) the x-y plane. The section 4U is further divided by the x-z plane into a subsection 4UL ($y<0$) and a subsection 4UR ($y>0$). The section 4D is further divided by the x-z plane and the plane O-C into a subsection 4DC (occupying the area between the x-y plane and the plane O-C), a subsection 4DL ($y<0$) and a subsection 4DR ($y>0$).

Figure 3:
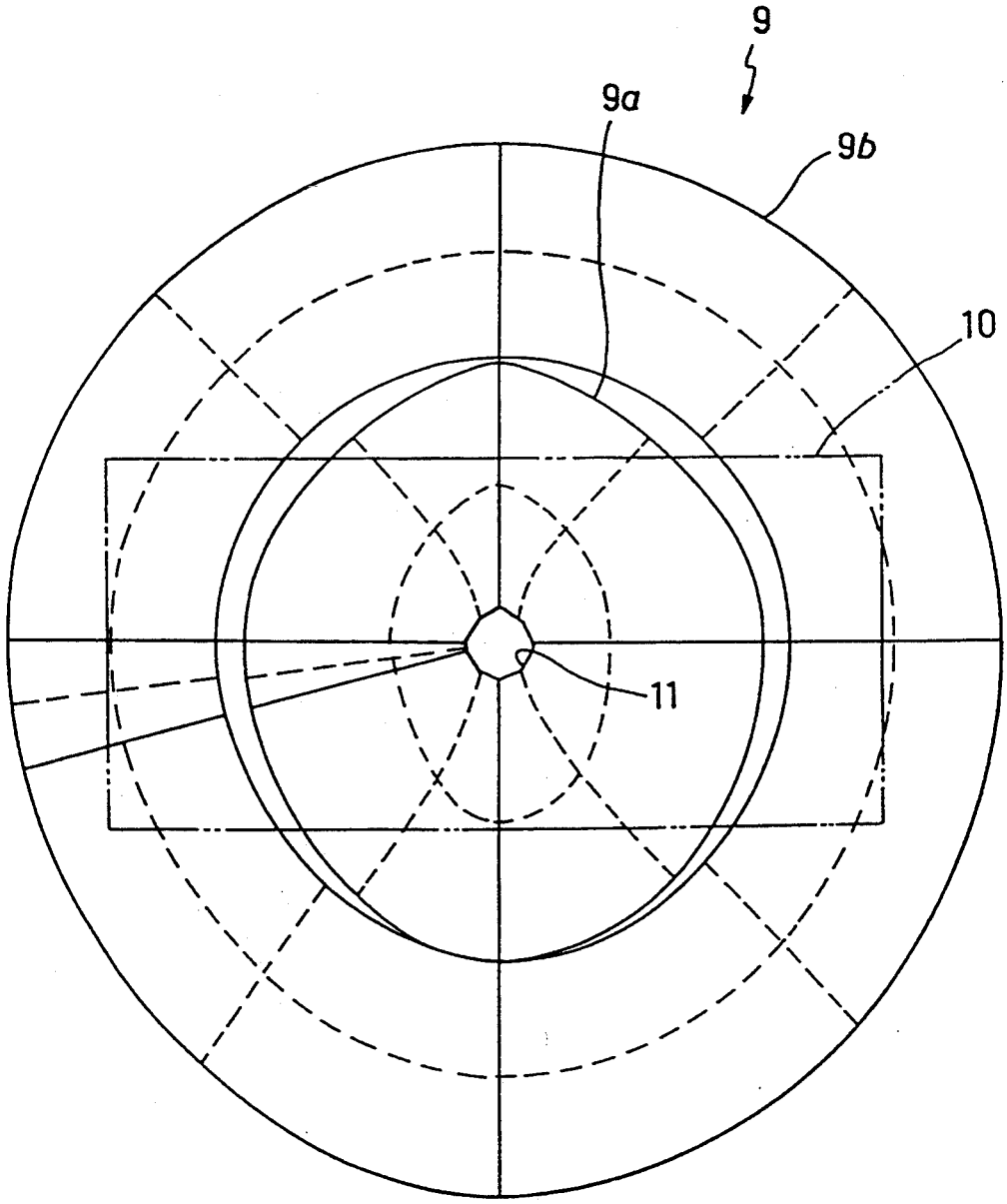
FIG. 3 is a front view of a fundamental surface.
Figure 4:
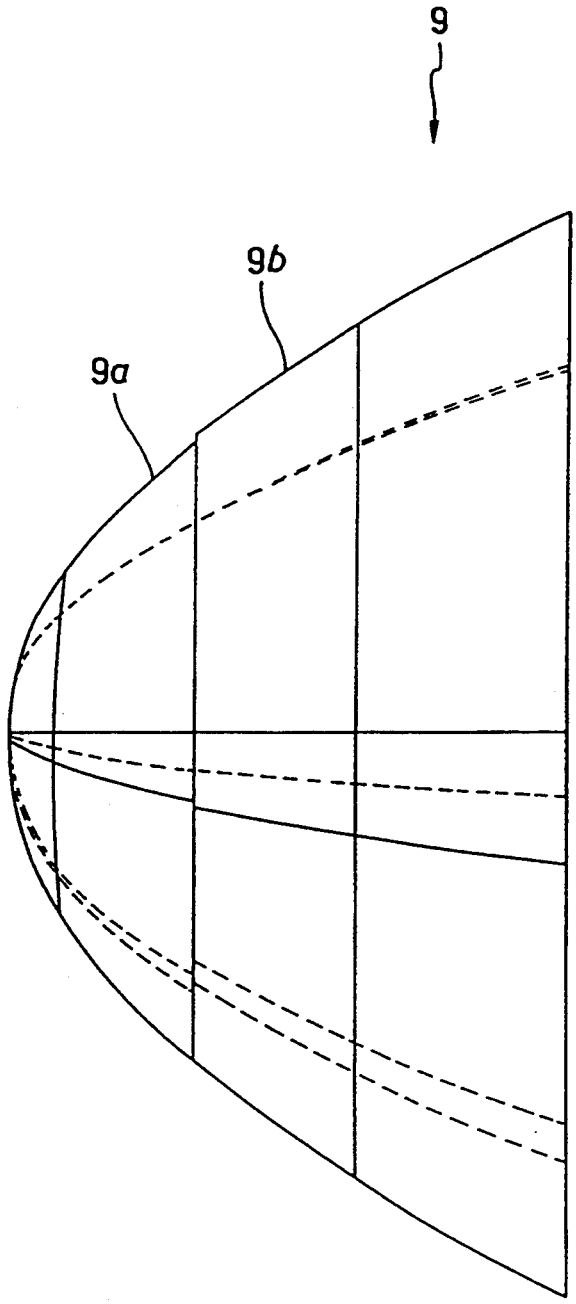
FIG. 4 is a side view of the fundamental surface.

FIGS. 3 and 4 show a fundamental surface 9 of the reflecting surface 2. In a front view of FIG. 3, a curved surface within a rectangle 10 indicated by a chain double-dashed line is the reflecting surface 2. FIG. 4 is a side view of the fundamental surface 9. The part of an inner surface 9*a* of the fundamental surface 9 cut out by the rectangle 10 is the inner surface 3 of the reflecting surface 2. The part of an outer surface 9*b* of the fundamental surface 9 cut out by the rectangle 10 is the outer surface 4 of the reflecting surface 2. A hole 11, into which a bulb is to be inserted, is formed at the center of the inner surface 9*a*.

Each of the surfaces 9*a* and 9*b* of the fundamental surface 9 is a "free surface" which cannot be defined exactly by an algebraic equation, and is designed by applying various kinds of CAD-based parameter control and vector control to the surface.

The process of generating a free surface is generally divided into a step of generating curves and a subsequent step of generating curved surfaces, and is briefly described below.

(1) Generation of curves 1-a) Input of parameters

A focal length of a basic parabola and a deformation ratio, a magnitude of a tangential vector, a target angle of a light beam, etc, are input to a computer.

1-b) Calculation of an equation of a curve

After a start point and an end point of a curve is determined based on the basic parabola and the deformation ratio, a free curve (e.g., a Ferguson curve) is determined by calculating the direction of the tangential vector from the target angle of the light beam and then defining its magnitude.

(2) Generation of curved surfaces 2-1) Input of parameters

An instruction as to whether to apply a restricting condition (orthogonal condition) to the tangential vector, a diameter of a basic ellipse, a twist vector, etc. are input to the computer.

The restricting condition on the tangential vector corresponds to an optical operation of making the central axes of filament images coincide with one another, and the twisting operation on the tangential vector corresponds to an optical operation of moving filament images in the direction perpendicular to their longitudinal directions. Details are described in U.S. patent application Ser. No. 07/783,992 filed on Oct. 29, 1991 and entitled "Reflector for Vehicle Headlight", which is hereby incorporated by reference.

2-b) Calculation of an equation of a curved surface

A surface patch (e.g., a double third-order patch of Coons) is generated. In determining patch coefficients, coordinates of points, tangential vectors for coordinates of a curve (surface parameters u and v), twist vectors, etc. are needed.

Since all the coordinates of the points and part of the tangential vectors have already determined by the free curve already obtained, the remaining tangential vectors are determined from the configurational parameters of the basic ellipse, the restricting conditions and the twist angles, and their magnitudes are thereafter adjusted. The calculation on the twist vectors is performed by properly using the Adini method, Forrest method, etc.

Each of the surfaces 9*a* and 9*b* is formed as a continuous surface of surface patches obtained according to the above procedure. Since the continuity at the boundary of the adjacent surface patches is assured, they are smoothly connected to each other. The boundary lines indicated by solid lines in FIGS. 1, 3 and 4 are drawn just for convenience of description and are not recognizable by human eyes.

On the other hand, in this embodiment the continuity is not assured at the boundary between the surfaces 9*a* and 9*b*. If glare due to a step at the boundary appears conspicuously, it is a matter of course that the two surfaces 9*a* and 9*b* should be connected smoothly.

FIGS. 5–9 show relationships between the subsections constituting the inner surface 3 of the reflecting surface 2 and respective patterns projected on the front screen.

Figure 5:
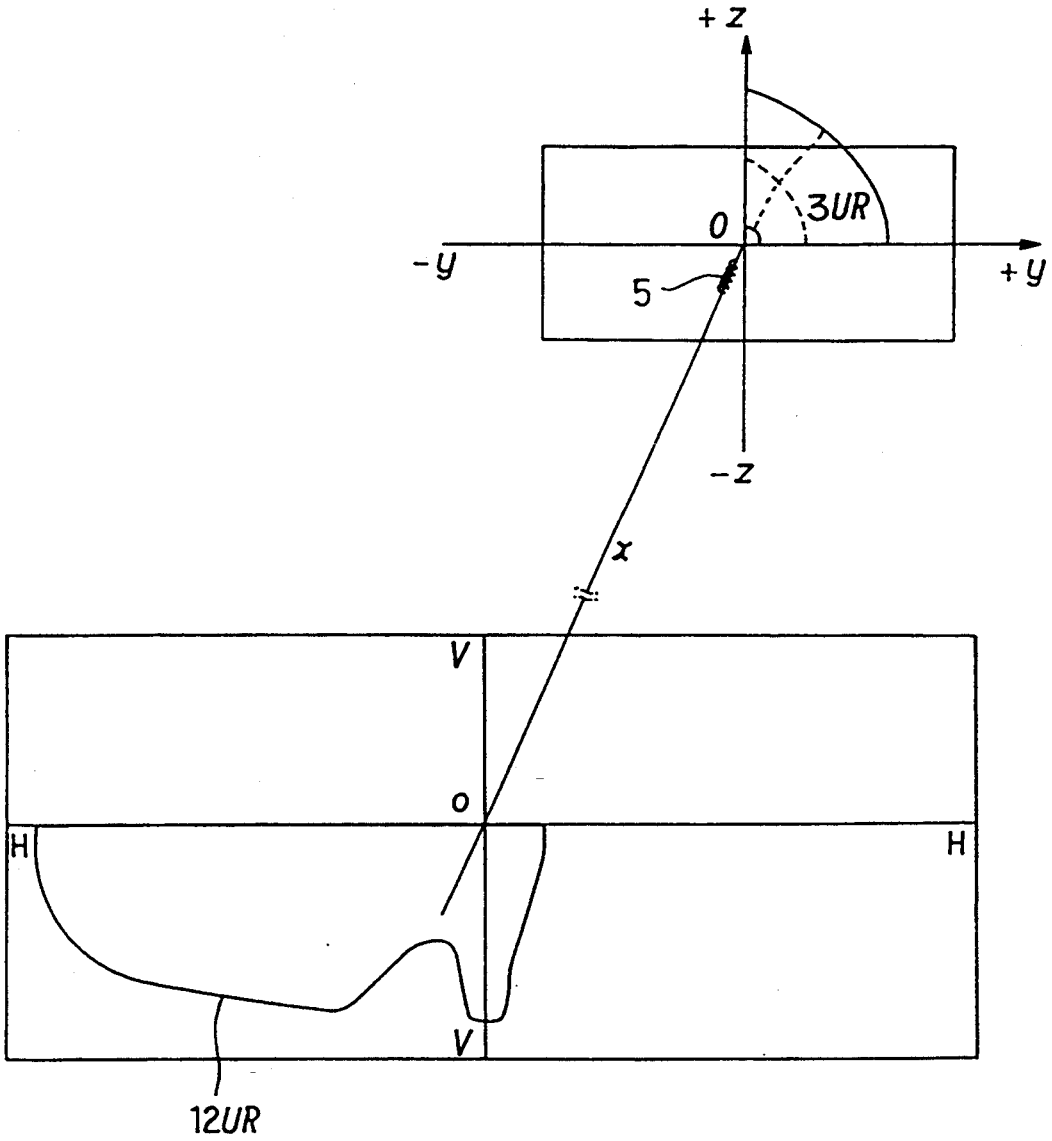
FIG. 5 shows a subsection 3UR of FIG. 1 and a corresponding projection pattern.

FIG. 5 shows the subsection 3UR and a corresponding projection pattern 12UR. Filament images are formed generally in an area opposite to the subsection 3UR with respect to the optical axis, i.e., on one side of the vertical line V—V and below the horizontal line H—H. The projection pattern 12UR is spread in the horizontal direction, and its upper edge contributes to the formation of the horizontal cutline.

Figure 6:
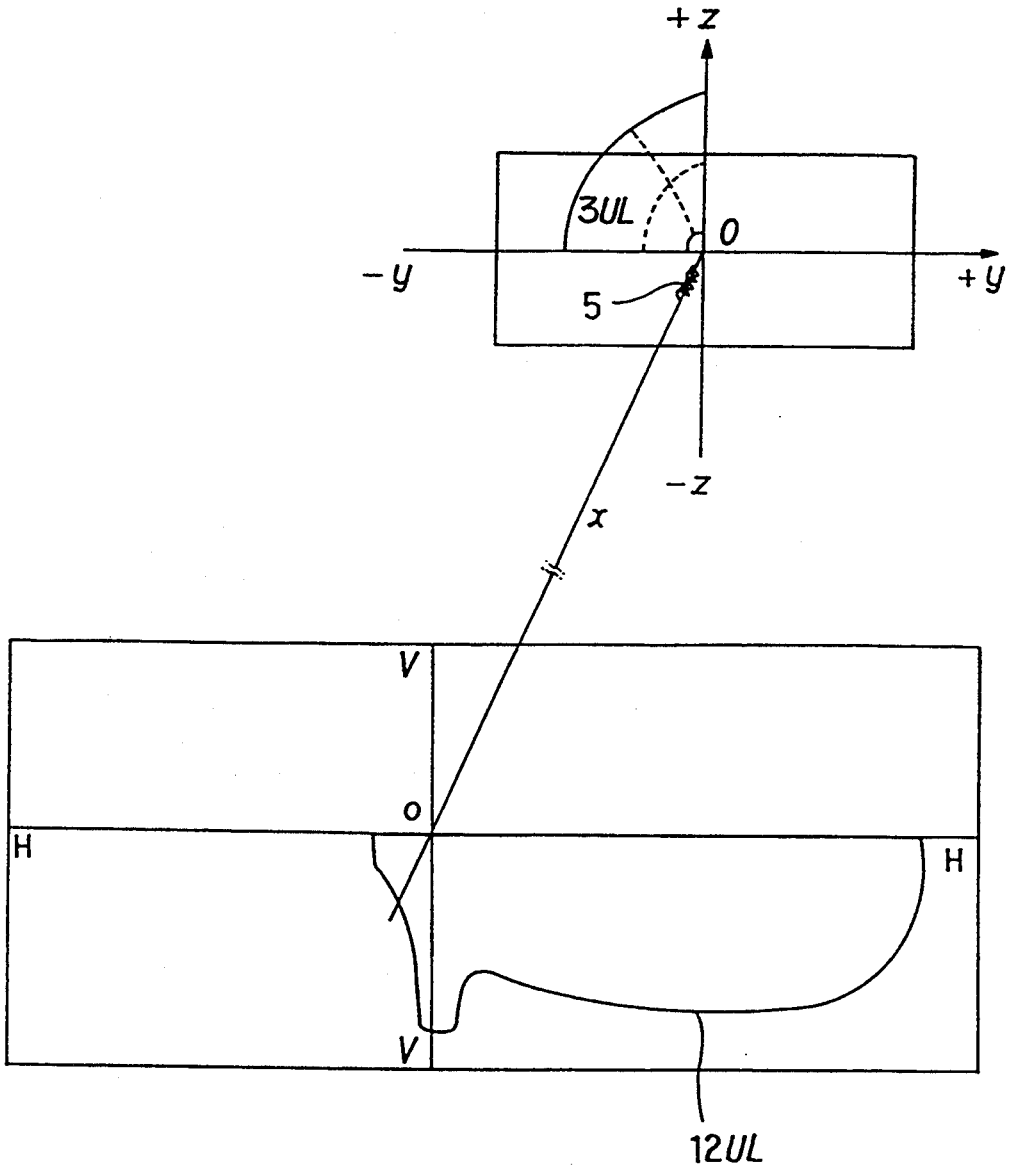
FIG. 6 shows a subsection 3UL of FIG. 1 and a corresponding projection pattern.

FIG. 6 shows the subsection 3UL and a corresponding projection pattern 12UL. Filament images are formed generally in an area opposite to the subsection 3UL with respect to the optical axis, i.e., in an area opposite to the area of the projection pattern 12UR with respect to the vertical line V—V and below the horizontal line H—H. The projection pattern 12UL is spread in the horizontal direction.

Figure 7:
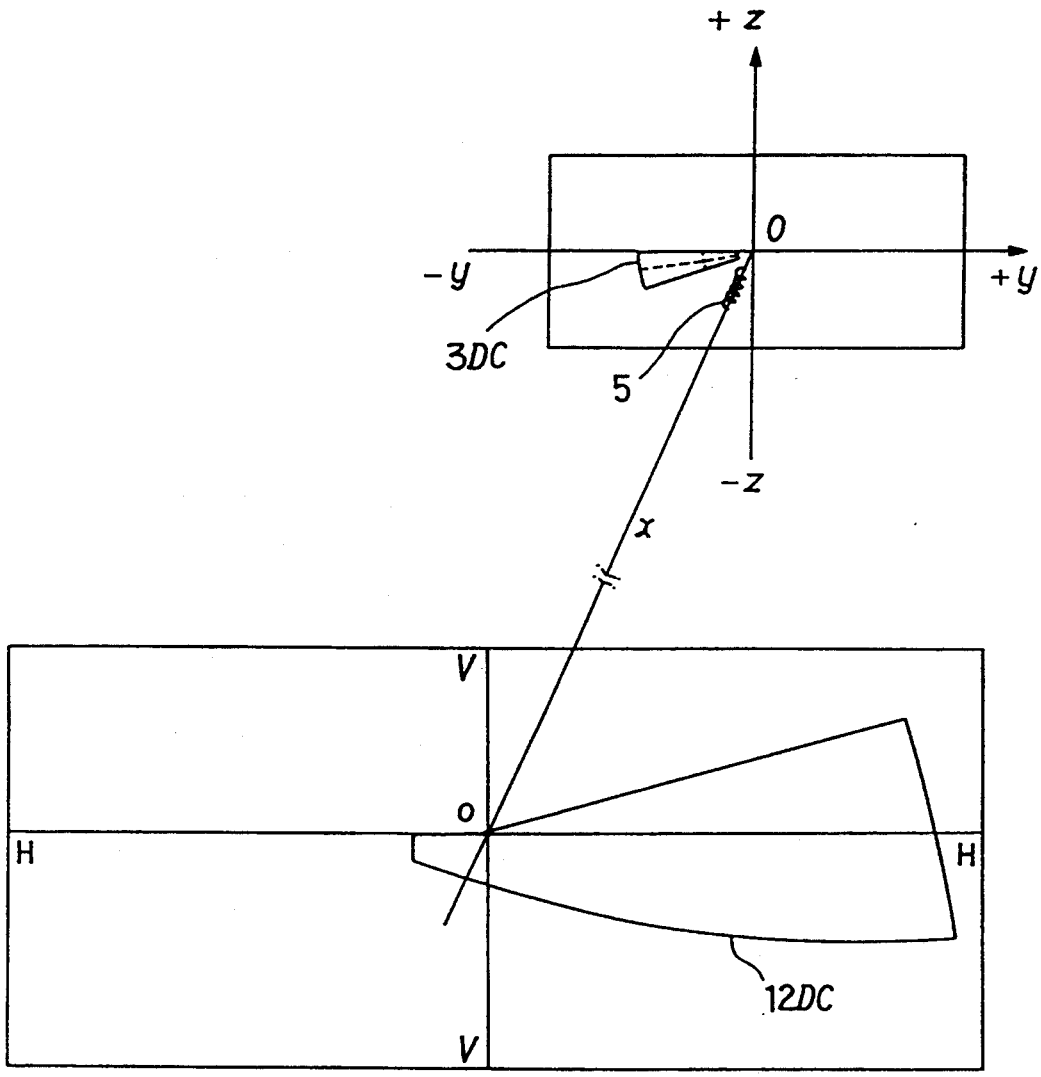
FIG. 7 shows a subsection 3DC of FIG. 1 and a corresponding projection pattern.

FIG. 7 shows the subsection 3DC and a corresponding projection pattern 12DC. Filament images are formed in an area opposite to the subsection 3DC with respect to the optical axis, i.e., on the same side of the vertical line V—V as the projection pattern 12DL and on both sides of the horizontal line H—H. Since the filament images are arranged radially from the point o, the projection pattern 12DC assumes a generally fan-shaped pattern, and its upper edge contributes to the formation of the cutline that is inclined from the horizontal line H—H by the predetermined angle.

Figure 8:
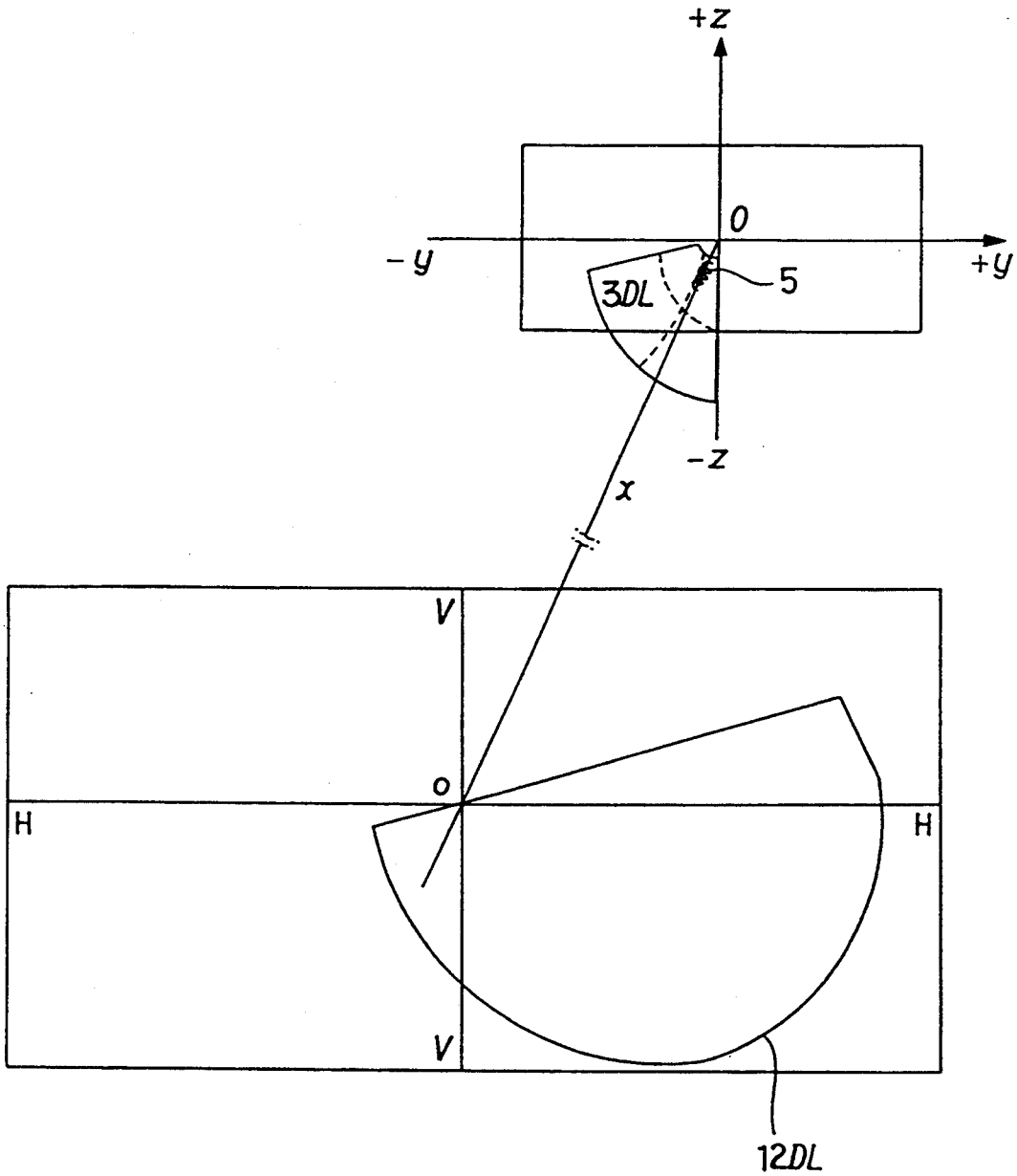
FIG. 8 shows a subsection 3DL of FIG. 1 and a corresponding projection pattern.

FIG. 8 shows the subsection 3DL and a corresponding projection pattern 12DL. Filament images are formed in an area opposite to the subsection 3DL with respect to the optical axis, i.e., on the same side of the vertical line V—V as the projection pattern 12DC and on both sides of the horizontal line H—H. The generally semi-circular projection pattern 12DL occupies a relatively large area, and its upper edge contributes to the formation of the inclined cutline.

Figure 9:
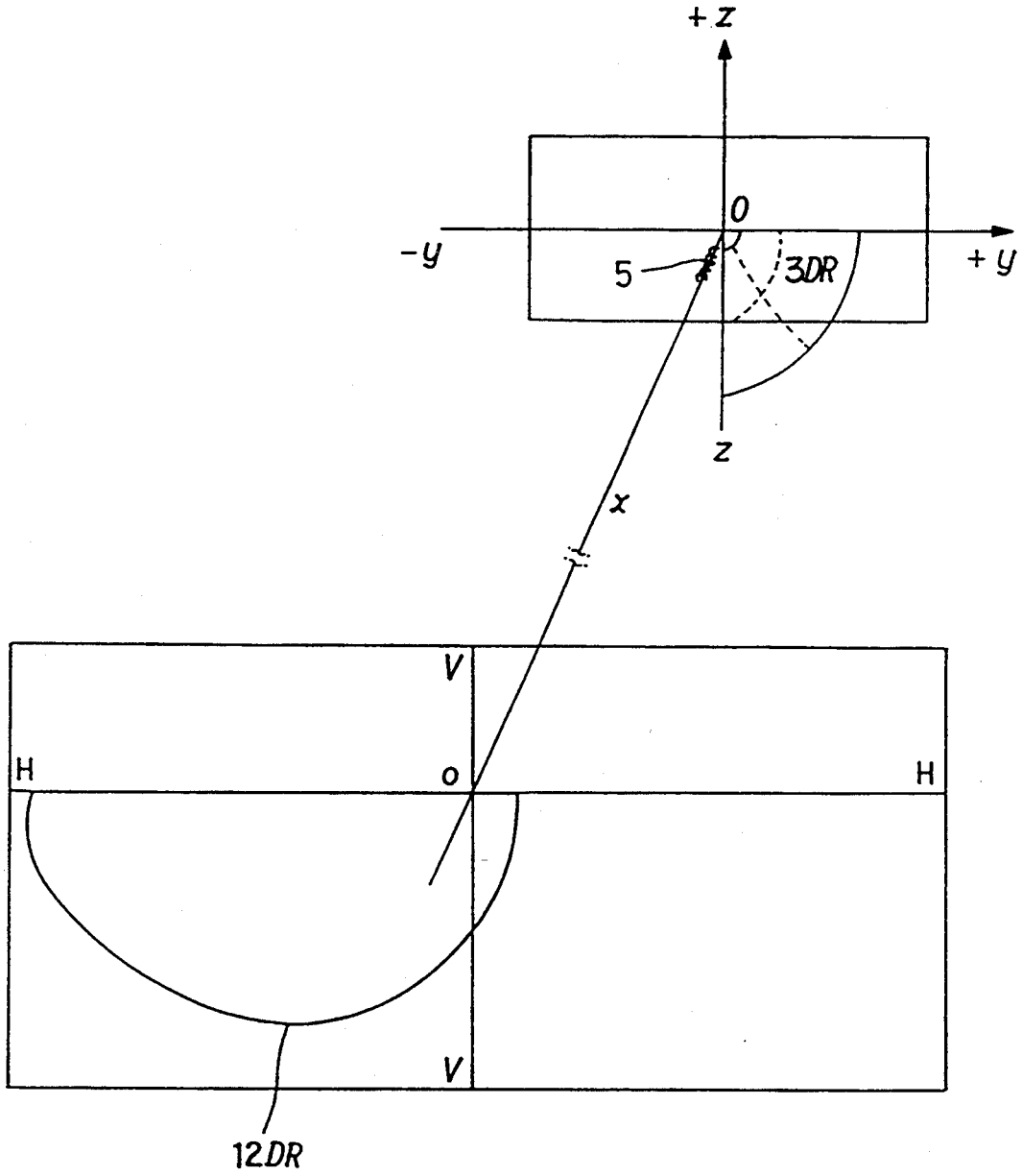
FIG. 9 shows a subsection 3DR of FIG. 1 and a corresponding projection pattern.

FIG. 9 shows the subsection 3DR and a corresponding projection pattern 12DR. Filament images are formed generally in an area opposite to the subsection 3DR with respect to the optical axis, i.e., on the same side of the vertical line V—V as the projection pattern 12UR and below the horizontal line H—H. The projection pattern 12DR is spread in the horizontal direction, and its upper edge contributes to the formation of the horizontal cutline.

FIGS. 10–15 show relationships between the subsections constituting the outer surface 4 of the reflecting surface 2 and respective patterns projected on the front screen.

Figure 10:
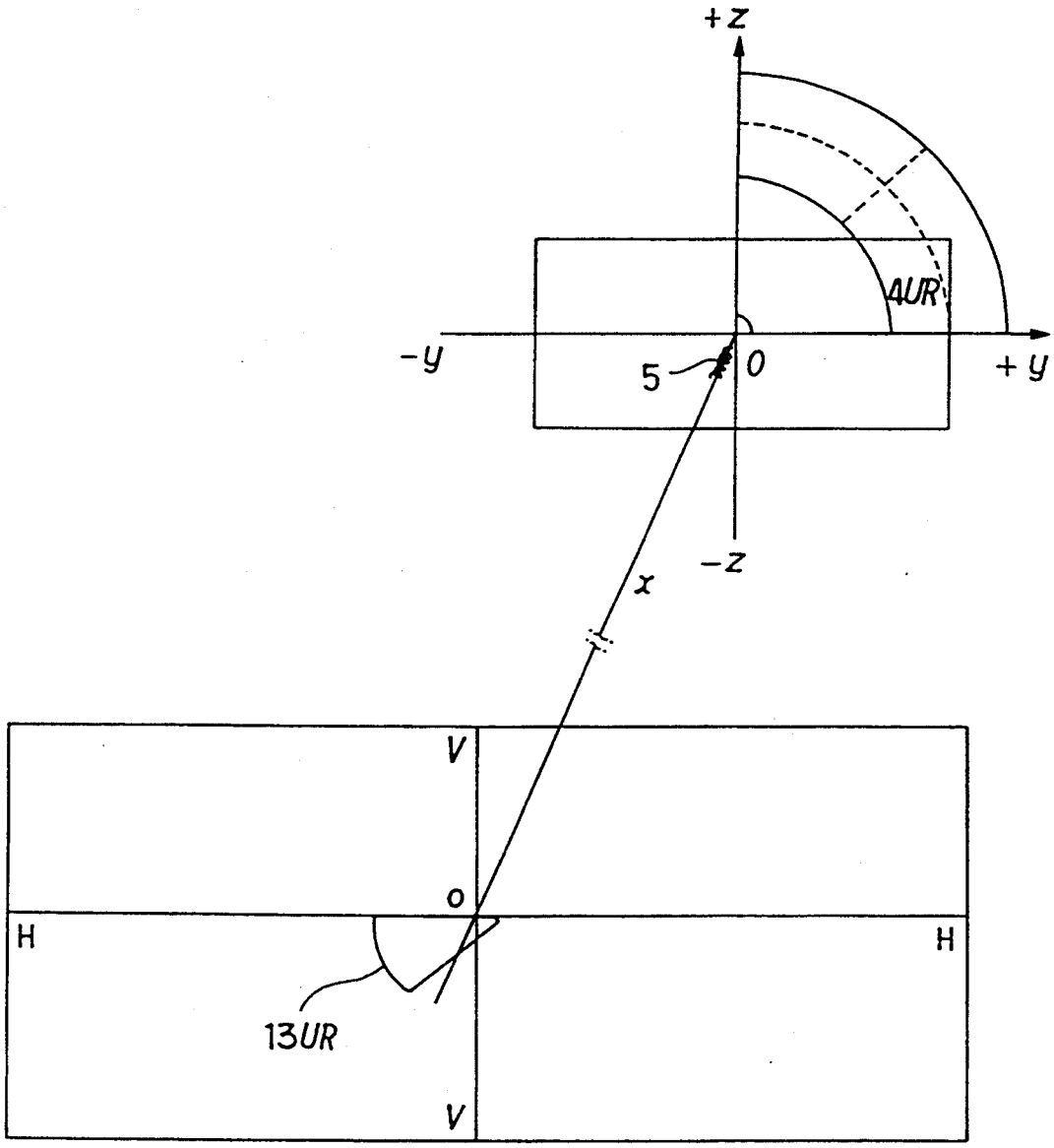
FIG. 10 shows a subsection 4UR of FIG. 1 and a corresponding projection pattern.

FIG. 10 shows the subsection 4UR and a corresponding projection pattern 13UR. Filament images are formed generally in an area opposite to the subsection 4UR with respect to the optical axis, i.e., on the same side of the vertical line V—V as the projection pattern 12DR and below the horizontal line H—H. The projection pattern 13UR assumes a generally fan-shaped pattern, and occupies a limited area near the point o. The upper edge of the projection pattern 13UR contributes to the formation of the horizontal cutline.

Figure 11:
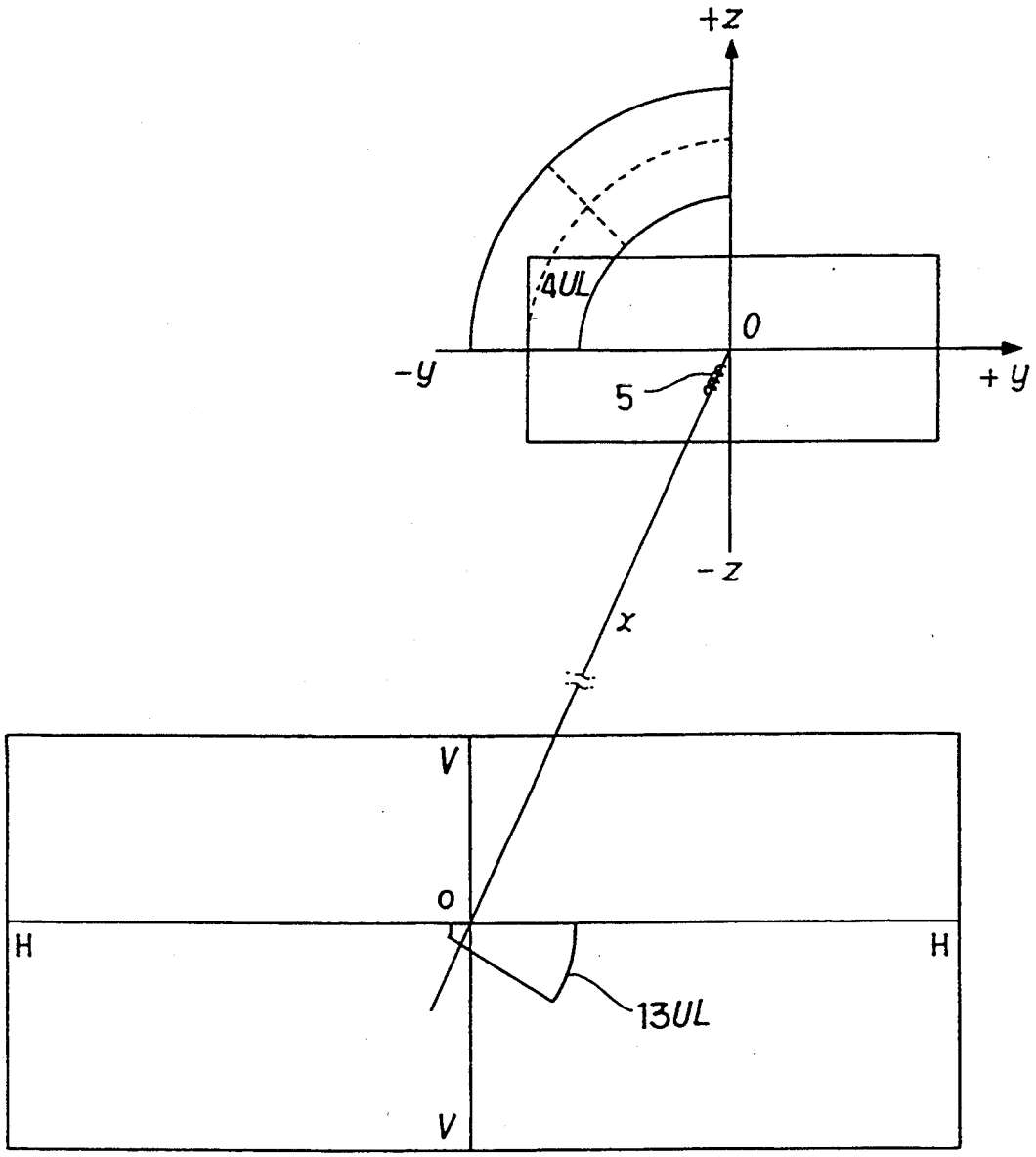
FIG. 11 shows a subsection 4UL of FIG. 1 and a corresponding projection pattern.

FIG. 11 shows the subsection 4UL and a corresponding projection pattern 13UL. Filament images are generally formed in an area opposite to the subsection 4UL with respect to the optical axis, i.e., in an area opposite to the projection pattern 13UR with respect to the vertical line V—V and below the horizontal line H—H. The projection pattern 13UL assumes a generally fan-shaped pattern, and occupies a limited area near the point o.

Figure 12:
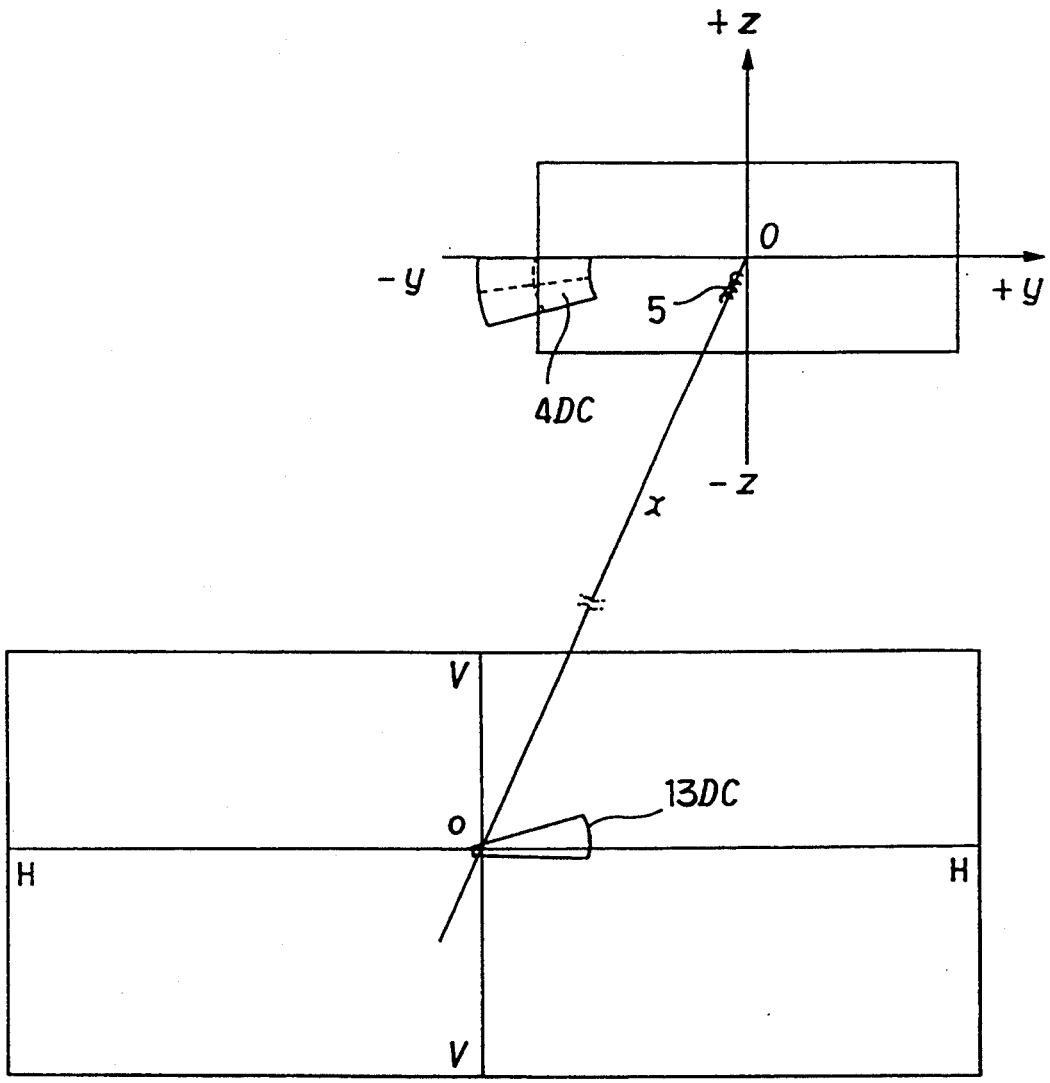
FIG. 12 shows a subsection 4DC of FIG. 1 and a corresponding projection pattern.

FIG. 12 shows the subsection 4DC and a corresponding projection pattern 13DC. Filament images are formed in an area opposite to the subsection 4DC with respect to the optical axis, i.e., on the same side of the vertical line V—V as the projection pattern 13UL and on both sides of the horizontal line H—H. The projection pattern 13DC assumes a generally fan-shaped pattern of a small central angle, and contributes to the formation of the inclined cutline.

Figure 13:
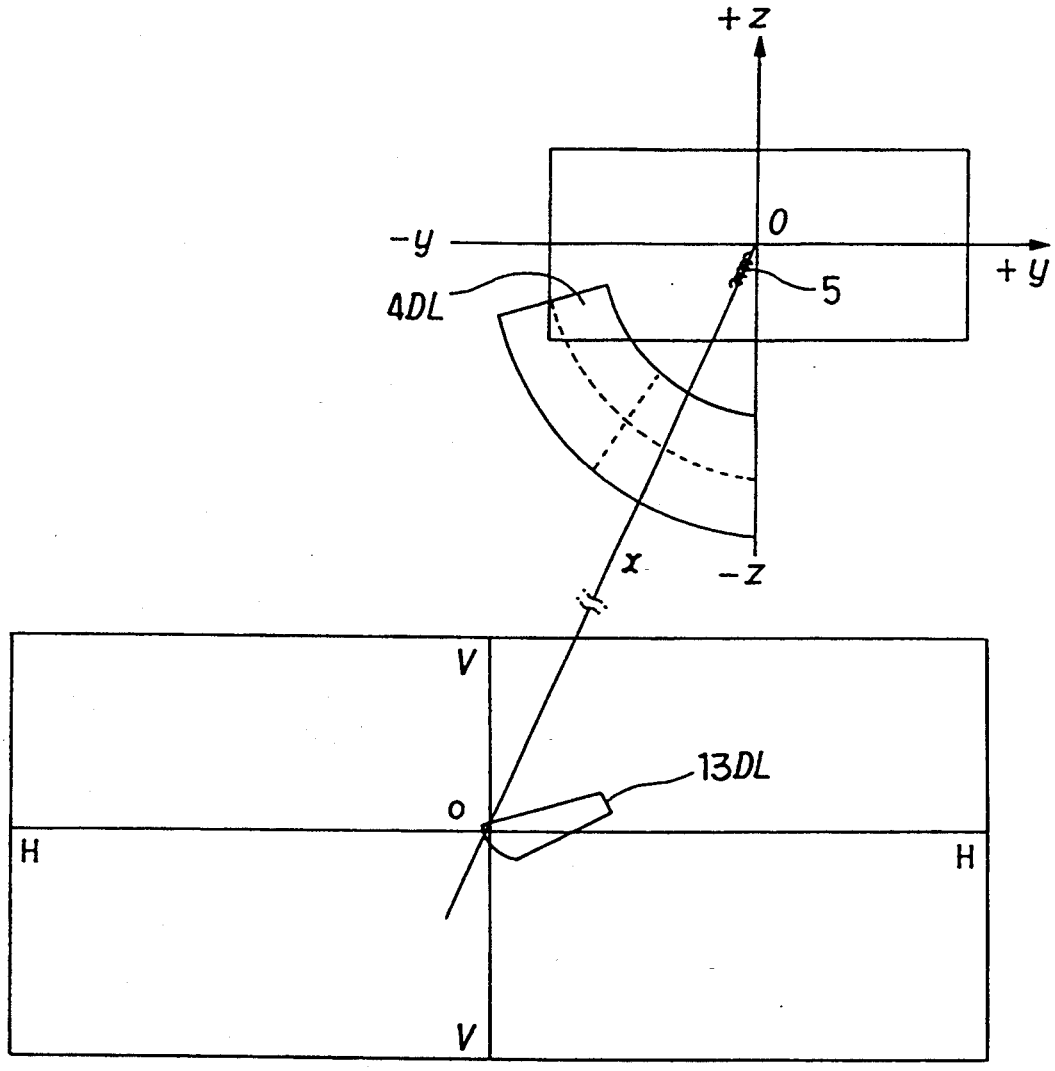
FIG. 13 shows a subsection 4DL of FIG. 1 and a corresponding projection pattern.

FIG. 13 shows the subsection 4DL and a corresponding projection pattern 13DL. Filament images are formed in an area opposite to the subsection 4DL with respect to the optical axis, i.e., on the same side of the vertical liens V—V as the projection pattern 13DC and on both sides of the horizontal line H—H. The projection pattern 13DL occupies a limited area on both sides of the horizontal line H—H. Its longitudinal central axis is inclined from the horizontal line H—H, and its upper edge contributes to the formation of the inclined cutline.

Figure 14:
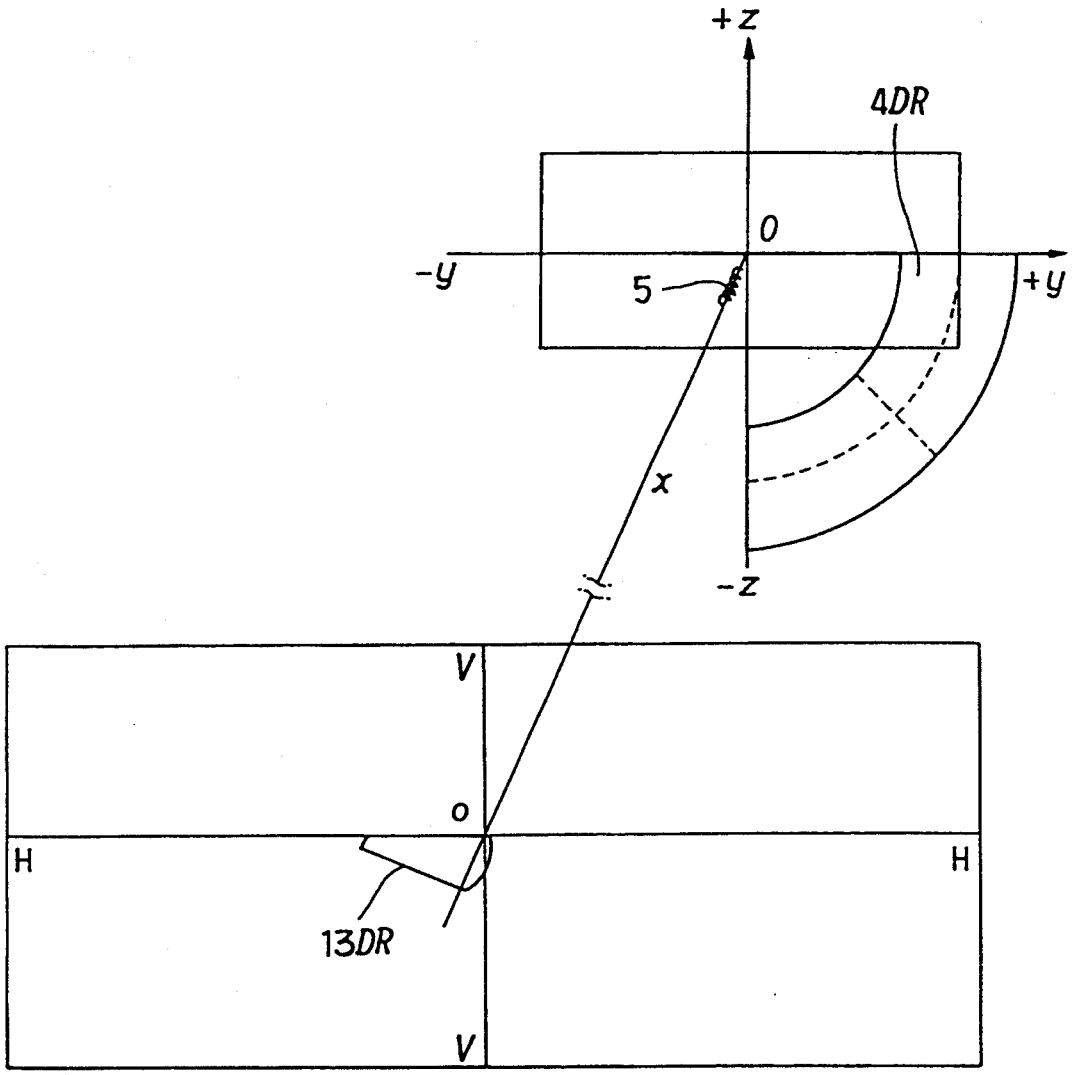
FIG. 14 shows a subsection 4DR of FIG. 1 and a corresponding projection pattern.

FIG. 14 shows the subsection 4DR and a corresponding projection pattern 13DR. Filament images are formed generally in an area opposite to the subsection 4DR with respect to the optical axis, i.e., on the same side of the vertical line V—V as the projection pattern 13UR and below the horizontal line H—H. Since the filament images are arranged radially from an imaginary point in the vicinity of the horizontal line H—H spaced from the point o by a certain distance, the projection pattern 13DR assumes a generally fan-shaped pattern of a small central angle, and its upper edge contributes to the formation of the horizontal cutline.

Figure 15:
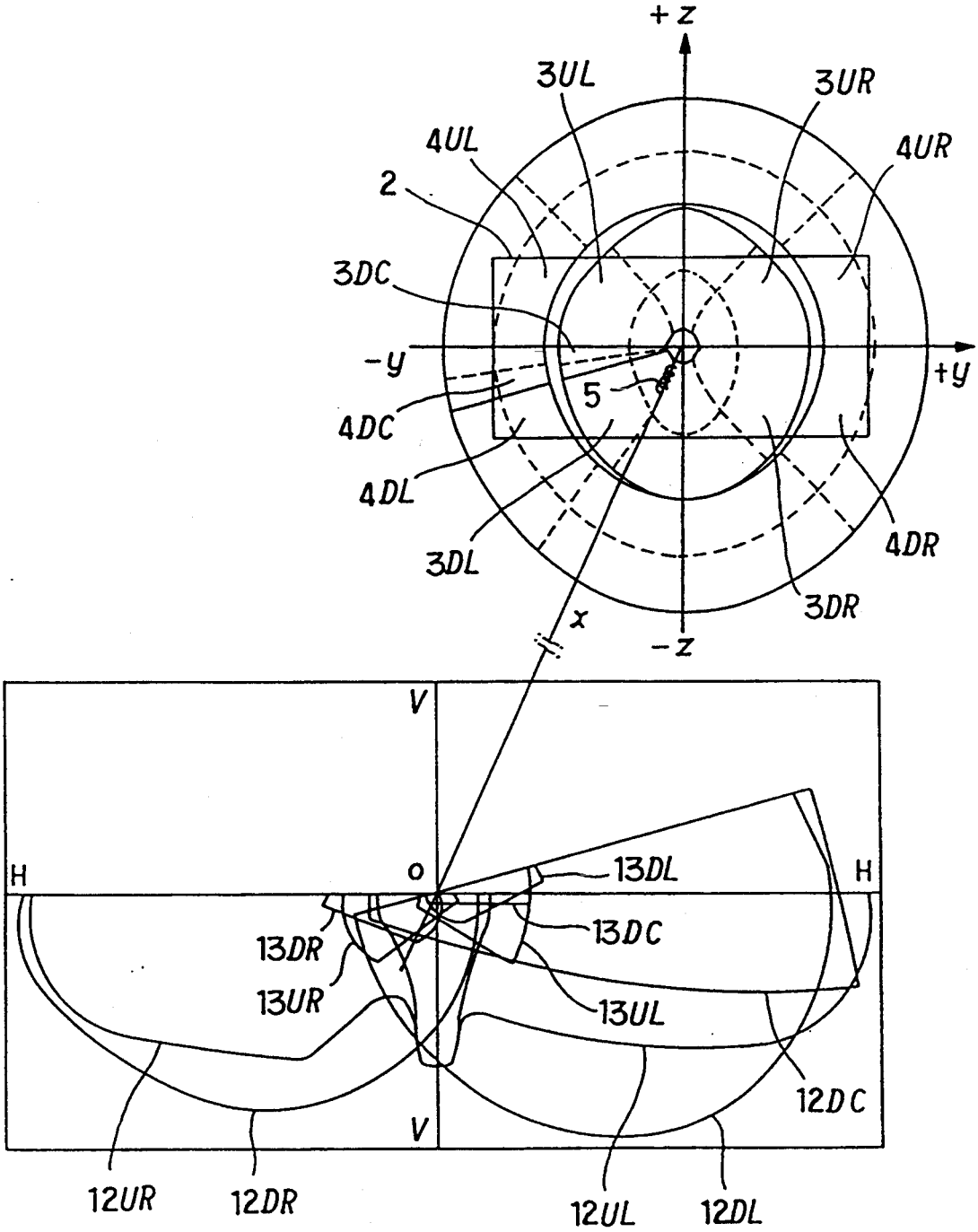
FIG. 15 shows the reflecting surface according to the invention and the corresponding overall projection pattern.

As shown in FIG. 15, the entire projection pattern of the reflecting surface 2 is formed as a combination of the above-described partial projection patterns. The light-distribution pattern having the cutline can be produced only by the function of the reflecting surface 2 as a combination of the pattern formed by the contribution of light beams reflected by the inner surface 3 and being highly diffused in the horizontal direction and the pattern formed by the contribution of light beams reflected by the outer surface 4 and concentrated near the point o.

Since the inner surface 3 and the outer surface 4 compensate each other with respect to the light-distribution control, to thereby satisfy both of sufficient central brightness and sufficient diffusion in the horizontal direction in the light-distribution pattern.

The low beam light-distribution pattern is finally obtained by correcting the above-described pattern by the lens steps of the outer lens. In the invention, it is possible to much reduce the light-distribution control function of the lens steps, that is, to use an outer lens having substantially no lens action.

As described above, according to the invention, the reflecting surface is divided into the inner surface and the outer surface, and a light-distribution pattern close to the standard low beam light-distribution pattern can be formed by the light-distribution control function of the reflecting surface as a combination of the pattern of the inner surface that is extended in the horizontal direction and the pattern of the outer surface that is concentrated in the central area. Therefore, the role of correcting the light-distribution that is imposed on the lens steps of the outer lens can be alleviated, to thereby facilitate provision of headlights having a large slant angle.

As for the formation of the cutline, the light beam traveling directions can be controlled so that the projection pattern of the subsection of each surface located below the horizontal plane including the optical axis and on one side of the vertical plane including the optical axis contributes to the formation of the cutline inclined from the horizontal line, and that the projection pattern of the subsection located on the other side of the vertical plane including the optical axis contributes to the formation of the cutline in parallel with the horizontal line. Therefore, the light beams reflected from the entire reflecting surface can be utilized as effective light beams to form the light-distribution pattern.

Although in the above embodiment each of the inner surface and the outer surface is divided into five subsections in terms of the light-distribution control, the scope of the invention is in no way limited to such a case. As is apparent from the fact that each of the inner surface and the outer surface of the invention does not have any clear boundary, there exists no limitation on the number of subsections divided in terms of the light-distribution control.

What is claimed is:

1. A vehicular headlight for producing a low beam light-distribution pattern comprising a reflector and a light source with a longitudinal dimension along an optical axis of the reflector, said reflector comprising:

a continuous, smooth inner surface surrounding the optical axis, for producing a projection pattern diffused in a horizontal direction, wherein an upper half of the inner surface produces a projection pattern below a horizontal center line, a first right-/left half section of a lower half of the inner surface produces a projection pattern contributing to formation of a first cutline inclined from the horizontal center line, and a second right/left half section of the lower half of the inner surface produces a projection pattern contributing to formation of a second cutline in parallel with the horizontal center line; and a continuous, smooth outer surface located outside of and connected to the inner surface, for producing a projection pattern concentrated in a central area.

2. The vehicular headlight of claim 1, wherein an upper half of the outer surface produces a projection pattern below the horizontal center line, a first right-/left half section of a lower half of the outer surface produces a projection pattern contributing to formation of the first cutline, and a second right/left half section of the lower half of the outer surface produces a projection pattern contributing to formation of the second cutline.

3. The vehicular headlight of claim 1, wherein a projection pattern of a section of the outer surface is located generally within a projection pattern of a corresponding section of the inner surface located inside the section of the outer surface.

4. The vehicular headlight of claim 1, wherein the inner surface and the outer surface are smoothly connected to each other.

5. A vehicular headlight for producing a low beam light-distribution pattern comprising a reflector and a light source with a longitudinal dimension along an optical axis of the reflector, said reflector comprising:

a continuous, smooth inner surface surrounding said optical axis and extending at least a first distance measured orthogonally to said optical axis, for producing a projection pattern defused in a horizontal direction, wherein an upper half of said inner surface produces a projection pattern below a horizontal center line, a first right/left half section of a lower half of said inner surface produces a projection pattern contributing to formation of a first cutline inclined from said horizontal center line, and a second right/left half section of said lower half of sid inner surface produces a projection pattern contributing to formation of a second cutline in parallel with said horizontal center line; and a continuous, smooth outer surface located a second distance measured orthogonally from said optical axis, said second distance being greater than said first distance, and being connected to said inner surface, for producing a projection pattern concentrated in a central area.

6. The vehicular headlight of claim 5, wherein an upper half of said outer surface produces a projection pattern below said horizontal center line, a first right-/left half section of a lower half of said outer surface produces a production pattern contributing to formation of said first cutline, and a second right/left half section of said lower half of said outer surface produces a projection pattern contributing to formation of said second cutline.

7. The vehicular headlight of claim 5, wherein a projection pattern of a section of said outer surface is located generally within a projection pattern of a corresponding section of said inner surface located inside said section of said outer surface.

8. The vehicular headlight of claim 5, wherein said first and second distances are measured along a horizontal direction.

9. The vehicular headlight of claim 8, wherein said outer surface extends at least said second distance on both the right and left sides of said optical axis.

10. The vehicular headlight of claim 5, wherein a lens is disposed to cover said inner and outer reflector surfaces, said lens having substantially no light distribution function.

11. The vehicular headlight of claim 5, wherein said inner reflector surface is defined by at least said first distance extending from said optical axis in said vertical and horizontal directions.

12. The vehicular headlight of claim 11, wherein said outer surface second distance extends primarily in said horizontal direction but does not extend in said vertical direction.

* * * * *